US009951520B2

(12) United States Patent
Veys et al.

(10) Patent No.: US 9,951,520 B2
(45) Date of Patent: Apr. 24, 2018

(54) COLUMN FOR SUPPORTING A COVERING AND SCREEN CONSTRUCTION COMPRISING SUCH A COLUMN

(71) Applicant: RENSON SUNPROTECTION-SCREENS NV, Waregem (BE)

(72) Inventors: Thierry Veys, Deinze (BE); Kristof Lemiegre, Ghent (BE); Koen Verfaillie, Rumbeke (BE); Pieter Brabant, Oostnieuwkerke (BE); Michael Tokmaji, Waregem (BE); Patrick Perquy, Drongen (BE); Frederik Van Luchene, Zulte-machelen (BE); Bart Pieter Jules Abeel, Ledegem (BE)

(73) Assignee: RENSON SUNPROTECTION-SCREENS NV, Waregem (BE)

( * ) Notice: Subject to any disclaimer, the term of this patent is extended or adjusted under 35 U.S.C. 154(b) by 0 days.

(21) Appl. No.: 15/037,668

(22) PCT Filed: Nov. 14, 2014

(86) PCT No.: PCT/IB2014/066033

§ 371 (c)(1),
(2) Date: May 18, 2016

(87) PCT Pub. No.: WO2015/075609

PCT Pub. Date: May 28, 2015

(65) Prior Publication Data

US 2016/0298332 A1 Oct. 13, 2016

(30) Foreign Application Priority Data

Nov. 19, 2013 (BE) ..... 2013/0778

(51) Int. Cl.
*E04C 3/00* (2006.01)
*E04C 3/32* (2006.01)
(Continued)

(52) U.S. Cl.
CPC ..... *E04C 3/32* (2013.01); *E04F 10/02* (2013.01); *E04F 10/0681* (2013.01); *E06B 9/58* (2013.01); *E06B 2009/587* (2013.01)

(58) Field of Classification Search
CPC ..... E04C 3/32; E04F 10/02; E04F 10/0681; E06B 9/58; E06B 2009/587
(Continued)

(56) References Cited

U.S. PATENT DOCUMENTS 5,271,204 A * 12/1993 Wolf ..... A47B 96/1458 52/836
8,402,712 B2 * 3/2013 Ahearn ..... E04B 1/24 52/653.2
(Continued)

FOREIGN PATENT DOCUMENTS

BE 1019072 A5 2/2012
FR 2803365 A1 7/2001
(Continued)

OTHER PUBLICATIONS

International Search Report dated Feb. 26, 2015.

*Primary Examiner* — Patrick J Maestri
(74) *Attorney, Agent, or Firm* — Symbus Law Group, LLC; Clifford D. Hyra

(57) ABSTRACT

A column (1) for supporting a covering, comprising a core profiled section (2) having a plurality of fitting grooves in its periphery and a plurality of insertion profiled sections (3, 4, 5) which are each interchangeably fittable into each fitting groove, in such a way that the column (1) has a substantially rectangular cross section, each inserted insertion profiled
(Continued)

section (3, 4, 5) in each fitting groove forms a corner (10) of the rectangular cross section of the column (1) and each side wall of the column (1) between the insertion profiled sections (3, 4, 5) is formed by the core profiled section (2). The present invention also relates to a screen construction comprising such a column (1).

20 Claims, 4 Drawing Sheets

(51) Int. Cl.
*E04F 10/06* (2006.01)
*E06B 9/58* (2006.01)
*E04F 10/02* (2006.01)

(58) Field of Classification Search
USPC ..... 52/843, 844, 845
See application file for complete search history.

(56) References Cited

U.S. PATENT DOCUMENTS 9,010,046 B1 * 4/2015 Reilly ..... B44C 7/022 160/327
2012/0096776 A1 * 4/2012 Tugnoli ..... E04D 13/064 52/11

FOREIGN PATENT DOCUMENTS

JP S5027778 Y1 8/1975
WO WO1998/31912 A1 7/1998

* cited by examiner

COLUMN FOR SUPPORTING A COVERING AND SCREEN CONSTRUCTION COMPRISING SUCH A COLUMN

This application claims the benefit of Belgian Patent Application No. BE-2013/0778, filed Nov. 19, 2013, which is hereby incorporated by reference in its entirety.

FIELD OF THE INVENTION

The present invention relates to a column for supporting a covering, comprising a core profiled section having a plurality of fitting grooves in its periphery and a plurality of exchangeable insertion profiled sections which are each interchangeably fittable into each fitting groove, in such a way that, after fitting one of said insertion profiled sections into each fitting groove, the column has a substantially rectangular cross section.

In addition, the present invention relates to a screen construction comprising such a column.

BACKGROUND

Screen constructions of this type are usually erected in order to cover or to clear an outdoor area. Such screen constructions are thus often erected at residences, restaurants, shops and the like in order to protect an outdoor terrace or the like from the sun, precipitation and/or wind or to allow sunshine in temporarily. Said screen constructions may be configured in the form of awnings, pergolas, verandas, terrace coverings, carports, etc.

A screen construction of this type typically comprises a roof construction (covering) which is at least partially supported by columns. Said covering is typically supported on four (or more) columns or is also typically attached to a wall on one side for support and supported by two (or more) columns on the other side. Said covering may be configured in a permanent fashion, or may comprise a screen which can be rolled up and unrolled, or may comprise optionally rotatable slats, etc.

Screen constructions of this type are also often provided with electrical equipment, such as lighting and/or heating systems. Furthermore, said screen constructions are also often provided with screens at the side, in order to cover the opening between two columns. In this case, said opening may be covered, for example, by a screen which can be rolled up and unrolled. It is also possible for sliding walls or slatted walls or fixed wall elements, etc., to be provided.

A number of types of column have already been developed which also have other functions in addition to their function of supporting the covering. For instance, these columns may be adapted to comprise supply lines to the electrical equipment, or to comprise discharge pipes for drainage, or to comprise guide profiled sections for a screen, etc.

Preferably, it should be possible to use these columns in a multifunctional way, with it being possible to provide optional wall elements, such as screens or slatted walls or sliding walls or fixed wall elements, etc., adjoining said columns, optional drainage in said columns, optional lighting or heating systems, etc., as desired. For all of these options it is the aim for the finish of the exterior of the column to be as aesthetically appealing as possible.

BE 1 019 072 A5 describes a column system which closely corresponds to a column according to the present invention. In this case, said column system comprises a core profiled section and several insertion profiled sections. The core profiled section has a recess (fitting groove) in each of its four sides, into which recess in each case a filler profiled section, a screen guide or a slat guide and finishing profiled sections are fitted, as desired. After the filler profiled sections have been inserted into the fitting grooves, they extend substantially inside said fitting grooves. The slat guides, screen guides and finishing profiled sections extend partially inside and partially outside the fittings grooves after they have been inserted. Together, the profiled sections in each case form a column having a substantially rectangular cross section. The column as a whole, however, has a different cross section depending on which insertion profiled sections one wishes to attach to the core profiled section. Said column may become quite large. Depending on where one wishes to mount which insertion profiled sections, a number of types of profiled section may also be required. When it is desired to attach screen guides to two adjoining sides, the column will not have four attractively finished corners. A cavity will be present at the place where the sides to which the screen guides are attached meet.

FR 2 803 365 A1 and JP 50-27778 Y1 describe column systems, comprising a core profiled section and a plurality of insertion elements, with the core profiled section comprising a recess in its four side walls as well as in its four corners. The insertion elements for the recesses in the side walls are interchangeable and the insertion elements for the recesses in the four corners are interchangeable. It is possible to finish these columns in a simpler and more attractive way than the columns from BE 1 019 072 A5, but if it is desired that they have the same bearing power they will be even larger.

SUMMARY

The object of the present invention is to be able to use a column of this type in a more flexible manner, and to be able to configure it in a simpler and more compact manner, without any loss of bearing power.

This object of the present invention is achieved by providing a column for supporting a covering, comprising a core profiled section having a plurality of fitting grooves in its periphery and a plurality of interchangeable insertion profiled sections which are each interchangeably fittable into each fitting groove, in such a way that, after fitting one of said insertion profiled sections into each fitting groove, the column has a substantially rectangular cross section, wherein, after fitting one of said insertion profiled sections into each fitting groove, each inserted insertion profiled section forms a corner of the substantially rectangular cross section of the column and each side wall of the column between the insertion profiled sections is formed by the core profiled section.

A column of this type, according to the invention, can be used in a particularly flexible way. By suitably choosing the insertion profiled sections, it is possible to integrate a number of desired functions, such as the mounting of wall elements, guiding of screens or integration of electrical equipment, etc., into the column in a simple manner. Since the insertion profiled sections form the corners of the column, it is possible to provide these functions on the desired side of the column by suitably positioning the fitting grooves or rotating the core profiled section and by suitably choosing the insertion profiled sections. In this case, a column according to the present invention may furthermore always retain substantially the same shape, since in each case the side wall of the column is at least partially formed by the core profiled section and the inserted insertion profiled sections form the corners of the rectangular cross section of the column. This retention of substantially the same shape has a particularly aesthetically appealing effect. Moreover, constructing a column according to the present invention makes it possible to configure said column to be much more compact than comparable columns with comparable functions from the prior art.

By allowing an inserted insertion profiled section to form a corner of the rectangular cross section of the column, with the core profiled section forming the adjoining side walls of the column between the insertion profiled sections, it is possible to accommodate the insertion profiled sections in each case within the same rectangular shape of the column in a commercially favourable way. This is not possible in a cost-efficient way in a column in which insertion elements are fitted into cavities in the side walls of a core profiled section, such as the columns from BE 1 019 072 A5, FR 2 803 365 A10 or JP S50 27778 Y1. Such a product would therefore not be marketable.

In a particular embodiment of a column according to the present invention, at least one insertion profiled section forms part of a wall element. More specifically, this insertion profiled section may form part of a screen guide profiled section. However, said insertion profiled section may also form part, for example, of a window profiled section or an attachment profiled section for attaching a fixed wall element therein/thereto, etc.

As indicated in BE 1 019 072 A5, it is important when attaching screen and/or slat guides for guiding the lateral sides of a screen which can be rolled up and unrolled and/or for guiding a bottom slat of a screen which can be rolled up and unrolled for said screen and/or slat guides to be particularly well aligned, so that the screen can be rolled up and unrolled between said screen and/or slat guides without any problems. By fitting corresponding insertion profiled sections having screen and/or slat guides into the fitting groove of core profiled sections of columns according to the present invention which are arranged on either side of such a screen which can be rolled up and unrolled, it is also particularly simple to ensure that the screen and/or slat guides are well aligned in a column according to the present invention once the core profiled sections have been correctly installed.

In a column according to the present invention having an insertion profiled section which forms part of a wall element, the insertion profiled section preferably allows the wall element to extend substantially at right angles to a side wall adjoining the insertion profiled section.

The core profiled section of a column according to the present invention preferably comprises four fitting grooves and, after the insertion profiled sections have been fitted into the fitting grooves, said insertion profiled sections form the four corners of the rectangular cross section.

Providing four fitting grooves in the core profiled section into which insertion profiled sections may be inserted in order to form the four corners of the column, greatly increases the flexibility of a column according to the present invention. When a fitting groove is provided for every corner of the column, the column profiled section no longer has to be rotated in order to provide an insertion profiled section having the desired function on the desired side of the column.

In a particular embodiment of a column according to the present invention, the core profiled section is hollow. Such a hollow profiled section can have the desired strength to support a covering while using less material. Moreover, in a column according to the present invention, a hollow core profiled section also saves material with respect to comparable hollow columns according to the prior art. In all of the areas where the core profiled section delimits the side walls of the column, there is no additional material of the insertion profiled sections placed against it. As the core profiled section furthermore delimits the side walls of the column between the insertion profiled sections, a lot of the material of the core profiled section is on the outer sides of the column, which benefits the stability of the column.

The column preferably comprises a discharge pipe which is fittable into the cavity of the core profiled section. In that case, the fitting grooves are all free for insertion profiled sections to be fitted therein in order to provide the column with other desired functions than the function of water drainage.

Preferably, the core profiled section of a column according to the present invention has a substantially cross-shaped cross section.

In a particularly sturdy embodiment of a column according to the present invention, each fitting groove comprises a base and an upright wall on either side of the base, wherein each upright wall adjoins an outer wall of the core profiled section which is provided in order to form part of a side wall of the column, and wherein the base extends substantially obliquely with respect to said outer walls.

In order to further increase the flexibility of a column according to the present invention, said column preferably has a substantially square cross section after one of said insertion profiled sections has been fitted into each fitting groove. An embodiment of a column according to the present invention with a core profiled section having a substantially symmetrical cross section is even more flexible.

Preferably, at least one insertion profiled section of a column according to the present invention is fittable into each fitting cavity with the aid of a hook connection. When this insertion profiled section forms part of a wall element, said insertion profiled section is preferably securely hookable behind a surface of the core profiled section which is at right angles to the wall element. When said insertion profiled section more specifically forms part of a screen guide profiled section, the surface behind which said screen guide profiled section is securely hookable is preferably at right angles to a screen to be guided by the screen guide profiled section. When a screen then exerts tensile forces on said screen guide profiled section, said tensile forces are at least partially transmitted to said surface of the core profiled section via said hook connection.

In a further specific embodiment of a column according to the present invention, at least one insertion profiled section forms part of a light fitting.

Preferably, at least one insertion profiled section of a column according to the present invention is fittable into each fitting cavity with the aid of a click-fit connection.

The object of the present invention is also achieved by providing a screen construction comprising a column according to the present invention.

The present invention will now be explained in more detail by means of the following detailed description of some preferred embodiments of a column and a screen device according to the present invention. The aim of this description is solely to give illustrative examples and to indicate further advantages and features of these columns and screen devices, and can thus not be interpreted as a limitation of the area of application of the invention or of the patent rights defined in the claims.

BRIEF DESCRIPTION OF THE DRAWINGS

In this detailed description, reference numerals are used to refer to the attached drawings, in which.

DETAILED DESCRIPTION

Figure 1:
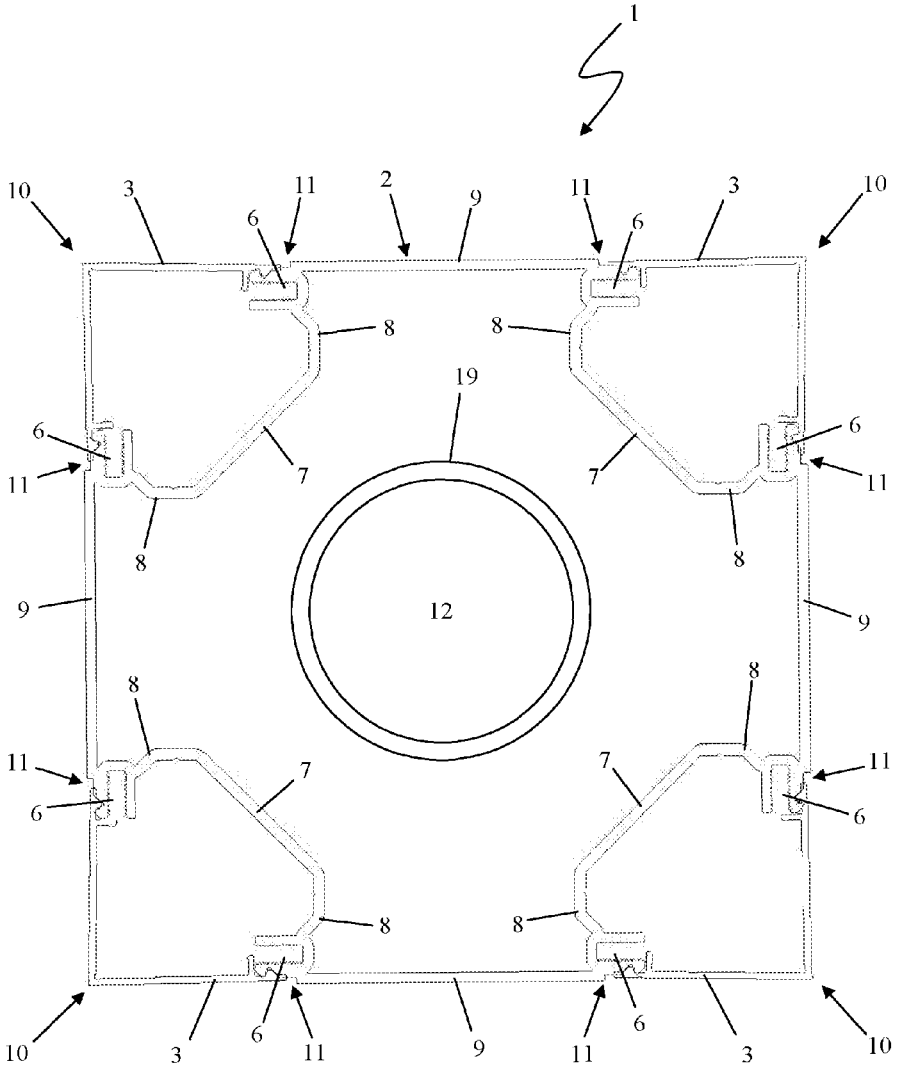
FIG. 1 shows a cross section of an embodiment of a column according to the present invention, in which finishing profiled sections are fitted into the fitting grooves of the core profiled section as insertion profiled sections.

The column (1) illustrated in the figures comprises a core profiled section (2) and a plurality of insertion profiled sections (3, 4, 5, 15). This column (1) is designed to be accommodated in a terrace covering, in which it serves to support the roof construction of said terrace covering. Said column (1) could also be used, however, to support the roof construction of, for example, an awning, or a pergola, or a veranda, or a carport, etc.

The core profiled section (2) has a substantially cross-shaped cross section, with in each case a cavity extending on the outer side between the protruding legs of the cross shape, so that the core profiled section (2) comprises corresponding fitting grooves in its periphery. In this way, said core profiled section (2) comprises four fitting grooves which are arranged crosswise with respect to one another. Instead of four such fitting grooves, the core profiled section (2) could also comprise one single such fitting groove, or two, or three, depending on the number of functions to be integrated into the corresponding column (1). In that case, the core profiled section (2) itself will also no longer have such a cross-shaped cross section. From a structural engineering point of view, it is preferable for the core profiled section (2) to be constructed in a symmetrical manner, having such a substantially cross-shaped cross section. The core profiled section (2) will generally be made of aluminium via extrusion. It will therefore be hollow. When such a cross-shaped profiled section is configured to be hollow, it is possible to transfer a lot of material away from the centre of gravity next to the fitting grooves, within the same external dimensions, which increases the stability. Such a cross-shaped construction also increases the flexibility of use of such a core profiled section (2). A cross-shaped core profiled section (2) keeps the corners (10) of the column (1) free for the integration of the insertion profiled sections (3, 4, 5).

Instead of producing said core profiled sections (2) from aluminium via extrusion, it is also conceivable to produce said core profiled sections (2) from steel, for example, or from stainless steel, or from wood, etc. However, the use of these materials is less preferred.

The cavity (12) of the illustrated core profiled section (2) allows, for example, a discharge pipe to be fitted therein for drainage of a covering underneath which a column (1) constructed therewith is arranged. It is also possible to integrate, for example, electric lines in said cavity (12). However, it is more advantageous to install such electric lines into cavities of insertion profiled sections, or in cavities between insertion profiled sections (4, 15) and the core profiled section (2), as they then remain more easily accessible.

The fitting grooves in the illustrated core profiled section (2) each comprise a base (7) and an upright wall (8) on either side of the base (7), with each upright wall (8) adjoining an outer wall (9) of the core profiled section (2) which is provided in order to form part of a side wall of the column (1). The base (7) of each fitting groove extends substantially obliquely with respect to said outer walls (9). In this way, yet more material of the core profiled section (2) is brought to the exterior, with sufficient space remaining in the fitting grooves for insertion profiled sections (3, 4, 5, 15) having a specific function to be fitted into said fitting grooves. The base (7) could optionally be curved, but this would require yet more material.

The insertion profiled sections (3, 4, 5, 15) are interchangeably fittable into the fitting grooves of the core profiled section (2). That is to say that it is possible to fit any desired insertion profiled section (3, 4, 5, 15) into any desired fitting groove of the core profiled section (2).

The insertion profiled sections (3, 4, 5, 15) are in each case configured differently depending on their desired function.

In FIG. 1, only finishing profiled sections (3) are fitted into the fitting grooves.

Figure 2:
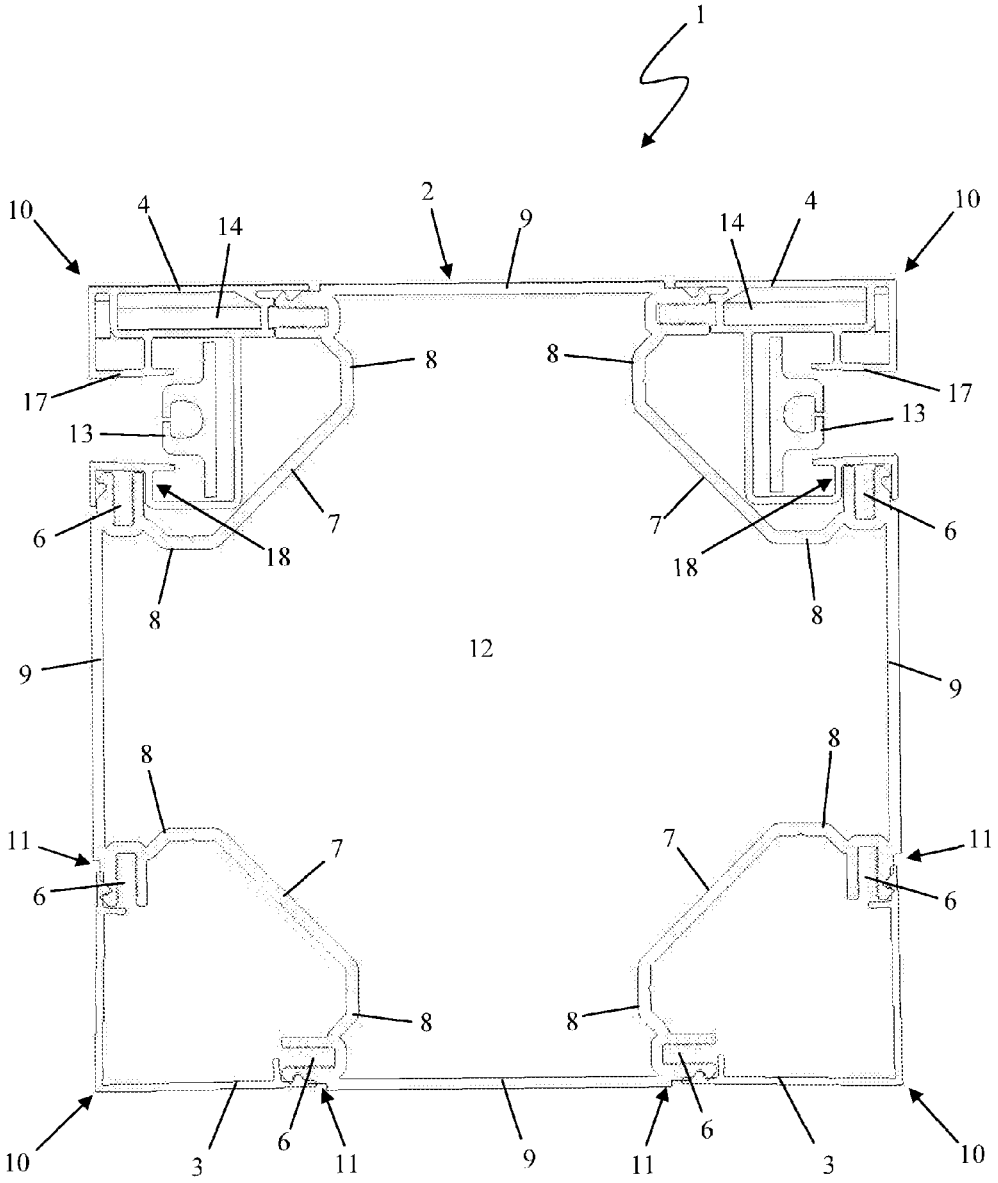
FIG. 2 shows a cross section of the column from FIG. 1, in which two finishing profiled sections are fitted on one side and two screen guide profiled sections are fitted on an opposite side into the fitting grooves of the core profiled section as insertion profiled sections.
Figure 3:
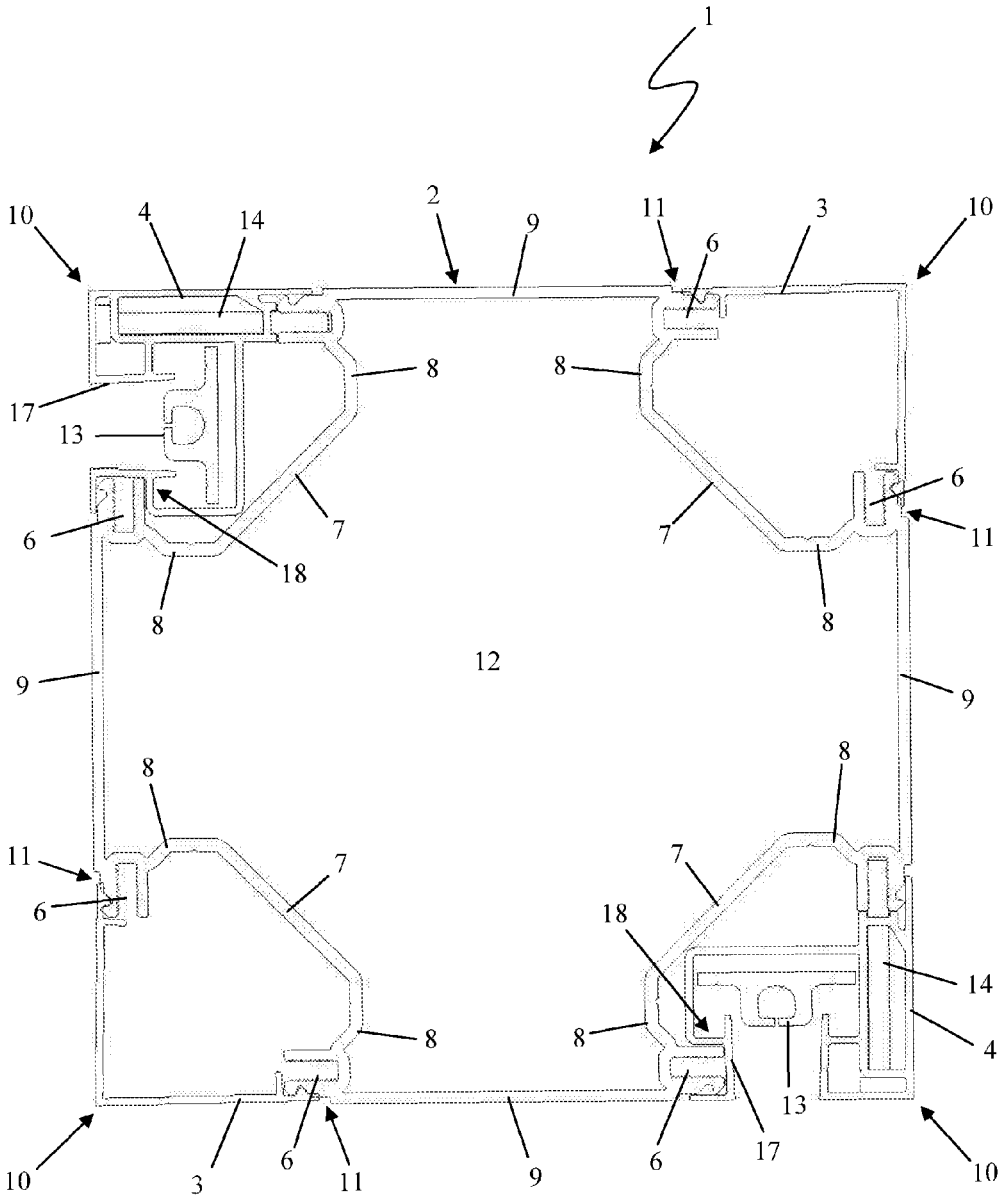
FIG. 3 shows a cross section of the column from FIG. 1, in which two finishing profiled sections are fitted diagonally with respect to one another and two screen guide profiled sections are fitted diagonally with respect to one another into the fitting grooves of the core profiled section as insertion profiled sections.
Figure 4:
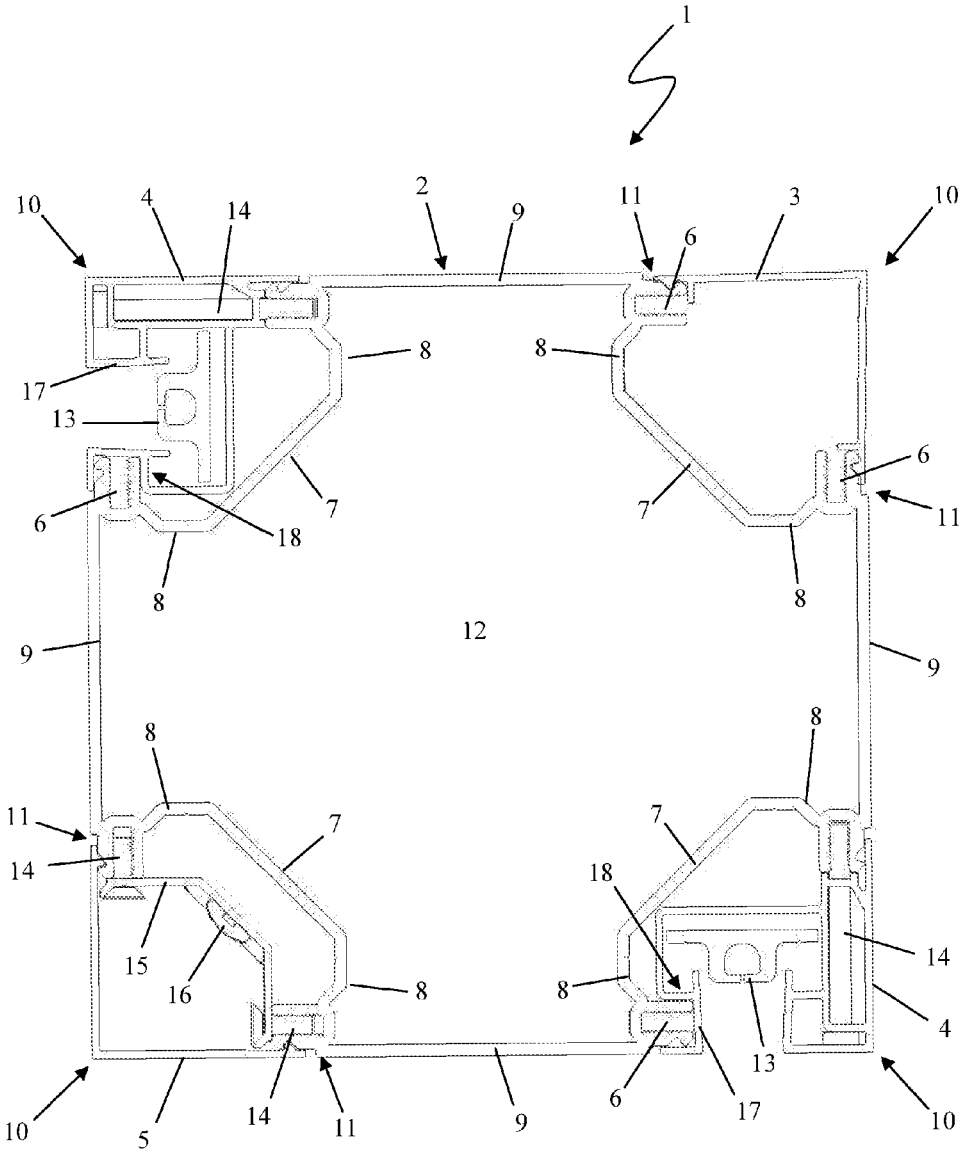
FIG. 4 shows a cross section of the column from FIG. 1, in which two finishing profiled sections are fitted diagonally with respect to one another and furthermore a finishing profiled section and a light fitting are fitted into the fitting grooves of the core profiled section.

In FIGS. 2, 3 and 4, screen guide profiled sections (4) are also fitted into the fitting grooves as well as the finishing profiled sections (3).

In FIG. 4, a mirror profiled section (15) and a covering profiled section (5) of a light fitting (5, 15) for LED lighting (16) are also additionally fitted.

Apart from the illustrated insertion profiled sections (3, 4, 5, 15), yet other possible insertion profiled sections are of course feasible, optionally having different functions.

The illustrated finishing profiled sections (3), screen guide profiled sections (4) and the covering profiled section (5) are in each case provided in such a way that when such a finishing profiled section (3) or screen guide profiled section (4) or covering profiled section (5) is fitted into each fitting groove of the core profiled section (2), said profiled sections together delimit a substantially square cross section of the column (1). In this case, the finishing profiled sections (3) and/or screen guide profiled sections (4) and/or covering profiled sections (5) form the corners of said substantially square cross section. A column (1) having such a substantially square cross section is preferred. However, it is also possible to provide such a column with a different (non-square) rectangular cross section.

After fitting insertion profiled sections (3, 4, 5, 15) into all fitting grooves of the core profiled section (2), said insertion profiled sections (3, 4, 5, 15) together form a substantially beam-shaped column (1). In this case, the core profiled section (2) extends substantially over the height of the column (1). The insertion profiled sections (3, 4, 5, 15) in this case also optionally extend substantially over the height of the column (1), or only part thereof. It may be desirable, for example, to provide LED lighting (16) over only part of the height of the column (1), in which case the corresponding light fitting (5, 15) is provided over the same height and the fitting groove is additionally closed off with a finishing profiled section or sections (3) of a corresponding length.

In order to be able to attach the insertion profiled sections (3, 4, 5, 15) to the core profiled section (2), said core profiled section (2) comprises screw channels (6), click-fit means and hook means.

The finishing profiled sections (3) comprise click-fit means which correspond to the click-fit means of the core profiled section (2), said click-fit means together being able to form a click-fit connection (11) in order to click-fit the finishing profiled sections (3) to the core profiled section (2).

The screen guide profiled sections (4), on the one hand, comprise hook means in order to hook behind the hook means of the core profiled section (2) and thus to form a hook connection (18) and, on the other hand, are designed to be screwed into a screw channel of the core profiled section (2) with the aid of screws (14). In said hook connection (18), a screen guide profiled section (4) hooks behind a surface of the core profiled section (2) which is at right angles to a screen to be guided using the screen guide profiled section (4). Tensile forces which a screen exerts on said screen guide profiled section (4) are then not only absorbed by the screws (14), but are also transmitted to the core profiled section (2) via this surface. The illustrated screen guide profiled sections (4) comprise guide walls (17) for guiding a bottom slat of a screen which can be rolled up and unrolled. Furthermore, a screen guide (13) is fitted in the screen guide profiled sections (4), in which screen guide (13) a thickened portion on the lateral side of a screen which can be rolled up and unrolled can be guided in order to guide said screen. As an alternative, screen guide profiled sections (4) may also be provided for guiding either solely the bottom slat of a screen which can be rolled up and unrolled and not the lateral sides of the screen, or solely thickened portions on the lateral sides of a screen which can be rolled up and unrolled and not the bottom slat. The illustrated screen guide profiled section (4) is configured in one part. However, it could also be constructed from a plurality of profiled sections.

The mirror profiled section (15) is designed to be screwed to the core profiled section (2) with the aid of screws (14) in the screw channels (6) of said core profiled section (2). LED lighting (16) is mounted on said mirror profiled section (15). After the mirror profiled section (15) has been screwed into a fitting groove, there is still space for further electronic components between the back of the mirror profiled section (15) and the base (7) of the fitting groove.

The covering profiled section (5) comprises click-fit means which correspond to the click-fit means of the core profiled section (2), said click-fit means together being able to form a click-fit connection (11) in order to click-fit the covering profiled section (5) to the core profiled section (2).

The finishing profiled sections (3), the screen guide profiled sections (4) and the mirror profiled section (15) are made from aluminium via extrusion. The mirror profiled section (15) is additionally provided with a reflective coating. The covering profiled section (5) is made of transparent plastic via extrusion. It is also possible to produce said insertion profiled sections (3, 4, 5, 15) from other materials or via other production methods. The covering profiled section (5) of a light fitting (5, 15) will of course always be produced from a likewise transparent material.

The column (1) as illustrated in FIG. 2 will typically serve to support two terrace coverings adjoining one another or, in the case of a relatively large terrace covering, will be arranged centrally in order to support one side of the covering, so that a screen which can be rolled up and unrolled may be provided on both sides of said column (1) and may be guided in the screen guide profiled sections (4). In the corners of this column (1) where finishing profiled sections (3) are provided, it is possible to opt for attaching a light fitting (5, 15) having LED lighting (16). At the outer corners of terrace coverings where screens which can be rolled up and unrolled are to be provided adjoining one another, the column (1) as illustrated in FIG. 2 will generally be selected, or the column (1) as illustrated in FIG. 4, if additional LED lighting (16) is desired. If no screens or LED lighting are desired, it is possible to select, for example, a column (1) as illustrated in FIG. 1. With all of the illustrated columns (1), it is also possible to mount, for example, adjoining sliding walls or slatted walls or fixed wall elements, etc. Of course, an endless number of variations are conceivable in terms of arranging said columns (1) and fitting adapted insertion profiled sections (3, 4, 5, 15) therein.

The invention claimed is:

1. Column for supporting a covering, comprising:

a core profiled section having a plurality of fitting grooves in its periphery; and a plurality of interchangeable insertion profiled sections which are each interchangeably fittable into each fitting groove, in such a way that, after fitting one of said insertion profiled sections into each fitting groove, the column has a substantially rectangular cross section;

wherein, after fitting one of said insertion profiled sections into each fitting groove, each inserted insertion profiled section forms a corner of the substantially rectangular cross section of the column and each side wall of the column between the insertion profiled sections is formed by the core profiled section;

wherein each of the plurality of interchangeable insertion profiled sections can be fitted into only one of the plurality of fitting grooves at a time;

wherein the core profiled section between the insertion profiled sections, which forms each side wall of the column, is straight, such that each side wall of the column has the appearance of a single planar surface when the insertion profiled sections are fitted into each fitting groove.

2. Column according to claim 1, characterized in that at least one insertion profiled section forms part of a wall element.

3. Column according to claim 2, characterized in that the insertion profiled section forming part of a wall element forms part of a screen guide profiled section.

4. Column according to claim 2, characterized in that the insertion profiled section allows the wall element to extend substantially at right angles to a side wall adjoining the insertion profiled section.

5. Column according to claim 1, characterized in that the core profiled section comprises four fitting grooves and in that, after fitting the insertion profiled sections into the fitting grooves, said insertion profiled sections form the four corners of the rectangular cross section.

6. Column according to claim 1, characterized in that the core profiled section is hollow.

7. Column according to claim 6, characterized in that said column comprises a discharge pipe which is fittable into a cavity of the core profiled section.

8. Column according to claim 1, characterized in that the core profiled section has a substantially cross-shaped cross section.

9. Column for supporting a covering, comprising a core profiled section having a plurality of fitting grooves in its periphery and a plurality of interchangeable insertion profiled sections which are each interchangeably fittable into each fitting groove, in such a way that, after fitting one of said insertion profiled sections into each fitting groove, the column has a substantially rectangular cross section, wherein, after fitting one of said insertion profiled sections into each fitting groove, each inserted insertion profiled section forms a corner of the substantially rectangular cross section of the column and each side wall of the column between the insertion profiled sections is formed by the core profiled section, wherein each fitting groove comprises a base and comprises an upright wall on either side of the base, wherein each upright wall adjoins an outer wall of the core profiled section which is provided in order to form part of a side wall of the column, and the base extends substantially obliquely with respect to said outer walls.

10. Column according to claim 1, characterized in that, after fitting one of said insertion profiled sections into each fitting groove, the column has a substantially square cross section.

11. Column according to claim 1, characterized in that at least one insertion profiled section is fittable into each fitting cavity with the aid of a hook connection.

12. Column for supporting a covering, comprising:

a core profiled section having a plurality of fitting grooves in its periphery; and a plurality of interchangeable insertion profiled sections which are each interchangeably fittable into each fitting groove, in such a way that, after fitting one of said insertion profiled sections into each fitting groove, the column has a substantially rectangular cross section;

wherein, after fitting one of said insertion profiled sections into each fitting groove, each inserted insertion profiled section forms a corner of the substantially rectangular cross section of the column and each side wall of the column between the insertion profiled sections is formed by the core profiled section;

wherein each of the plurality of interchangeable insertion profiled sections can be fitted into only one of the plurality of fitting grooves at a time;

wherein at least one insertion profiled section forms part of a wall element wherein the insertion profiled section allows the wall element to extend substantially at right angles to a side wall adjoining the insertion profiled section;

wherein at least one insertion profiled section is fittable into each fitting cavity with the aid of a hook connection, wherein the insertion profiled section which forms part of a wall element is securely hookable behind a surface of the core profiled section which is at right angles to the wall element.

13. Column according to claim 1, characterized in that at least one insertion profiled section forms part of a light fitting.

14. Column according to claim 1, characterized in that the insertion profiled sections are fittable into each fitting cavity with the aid of a click-fit connection.

15. Screen construction comprising a column according to claim 1.

16. Column according to claim 1, wherein, after fitting one of said insertion profiled sections into each fitting groove, each inserted insertion profiled section forms a single corner of the substantially rectangular cross section of the column.

17. Column according to claim 1, wherein the plurality of fitting grooves consists of four fitting grooves.

18. Column according to claim 1, wherein, after fitting one of said insertion profiled sections into each fitting groove, the column comprises four side walls, each of the four side walls comprising a portion of the core profiled section that extends between and directly adjacent to consecutive insertion profiled sections.

19. Column according to claim 1, wherein the core profiled section comprises four sidewall portions, one of the plurality of fitting grooves extending between each pair of consecutive sidewall portions.

20. Column according to claim 19, wherein each core profiled section sidewall portion forms one of the side walls of the column between the insertion profiled sections after fitting one of said insertion profiled sections into each fitting groove.

* * * * *